US008753162B2

(12) United States Patent
Jensen

(10) Patent No.: US 8,753,162 B2
(45) Date of Patent: Jun. 17, 2014

(54) BUILDING SET FOR TOY HOUSES

(75) Inventor: Anders Buus Jensen, Aalborg (DK)

(73) Assignee: Inordvativ A/S, Aalborg SV (DK)

( * ) Notice: Subject to any disclaimer, the term of this patent is extended or adjusted under 35 U.S.C. 154(b) by 272 days.

(21) Appl. No.: 13/382,230

(22) PCT Filed: Jul. 6, 2010

(86) PCT No.: PCT/DK2010/000104
§ 371 (c)(1),
(2), (4) Date: Jan. 31, 2012

(87) PCT Pub. No.: WO2011/003417
PCT Pub. Date: Jan. 13, 2011

(65) Prior Publication Data

US 2012/0122368 A1 May 17, 2012

(30) Foreign Application Priority Data

Jul. 9, 2009 (DK) ..... 2009 00844
Sep. 8, 2009 (DK) ..... 2009 01008

(51) Int. Cl.
*A63H 33/04* (2006.01)

(52) U.S. Cl.
USPC ..... 446/85; 446/108; 446/110

(58) Field of Classification Search
USPC ..... 446/85, 108, 110
See application file for complete search history.

(56) References Cited

U.S. PATENT DOCUMENTS 1,150,363 A * 8/1915 Haskins ..... 446/112
1,281,856 A * 10/1918 Shaw ..... 446/112
1,355,580 A * 10/1920 Tyson ..... 52/505
2,676,420 A * 4/1954 Berg ..... 434/72
3,362,739 A * 1/1968 Staeger et al. ..... 52/285.1
3,603,026 A * 9/1971 Kishigami ..... 446/122
3,827,177 A * 8/1974 Wengel ..... 446/112
3,874,133 A * 4/1975 Silvius ..... 52/285.4
3,913,289 A * 10/1975 Recker ..... 312/140
4,055,019 A * 10/1977 Harvey ..... 446/115

(Continued)

FOREIGN PATENT DOCUMENTS

CA 2057319 A 6/1993
DE 2203152 A 8/1973
DE 202007005299 U 7/2007
GB 2302040 A 1/1997

OTHER PUBLICATIONS

International Search Report for PCT/DK2010/000104, Mailed Oct. 20, 2010, 2 pages.

*Primary Examiner* — Gene Kim
*Assistant Examiner* — Urszula M Cegielnik
(74) *Attorney, Agent, or Firm* — William J. Sapone; Ware Fressola; Maguire & Barber LLP

(57) ABSTRACT

The invention is a set for building toy houses, in particular doll's houses and the like, including wall panels (1, 2, 3, 4) with and without openings for windows and doors, and coupling elements (5, 6, 7, 8) for assembling the wall panels. Each wall panel has a reduced thickness section in each corner thereof for insertion into a coupling element. The reduced thickness section extends on both sides of the wall panel as a plane, recessed section (10). Each recessed section extends between staggered edges (11) and is provided with a depression (12, 13) provided centrally on both sides thereof, the coupling element being configured with parallel lateral faces (14, 15) for enclosing the corner area.

13 Claims, 3 Drawing Sheets

(56) References Cited

U.S. PATENT DOCUMENTS

| | | | | | |
|---|---|---|---|---|---|
| 4,107,869 | A | * | 8/1978 | Abrams | 446/110 |
| 4,170,082 | A | * | 10/1979 | Freedman | 446/109 |
| 4,209,934 | A | * | 7/1980 | Ogawa | 446/109 |
| 4,227,337 | A | * | 10/1980 | Murray et al. | 446/102 |
| 4,334,868 | A | * | 6/1982 | Levinrad | 434/172 |
| 4,509,930 | A | * | 4/1985 | Schweigert et al. | 446/109 |
| 4,571,200 | A | | 2/1986 | Serna | |
| 4,685,892 | A | * | 8/1987 | Gould et al. | 446/109 |
| 4,731,041 | A | * | 3/1988 | Ziegler | 446/115 |
| 4,755,159 | A | * | 7/1988 | Templeton et al. | 446/76 |
| 4,792,319 | A | * | 12/1988 | Svagerko | 446/104 |
| 4,793,725 | A | * | 12/1988 | Cheng | 403/174 |
| 4,941,859 | A | * | 7/1990 | Zaruba | 446/476 |
| 5,100,358 | A | * | 3/1992 | Volgger | 446/104 |
| 5,212,842 | A | * | 5/1993 | Glydon | 5/420 |
| 5,222,902 | A | * | 6/1993 | Piersch | 446/121 |
| 5,490,362 | A | * | 2/1996 | Mercier | 52/582.1 |
| 5,501,626 | A | * | 3/1996 | Harvey | 446/104 |
| 5,600,910 | A | * | 2/1997 | Blackburn | 40/605 |
| 5,647,181 | A | * | 7/1997 | Hunts | 52/282.1 |
| 5,779,517 | A | * | 7/1998 | Clarke | 446/108 |
| 5,871,384 | A | | 2/1999 | Kichijo | |
| D409,668 | S | * | 5/1999 | Madner | D21/484 |
| 6,073,404 | A | * | 6/2000 | Norfleet | 52/236.3 |
| 6,142,848 | A | * | 11/2000 | Madner et al. | 446/115 |
| 6,176,757 | B1 | * | 1/2001 | Lin | 446/115 |
| 6,250,029 | B1 | * | 6/2001 | Jeffers et al. | 52/220.7 |
| 6,443,798 | B1 | * | 9/2002 | Perry | 446/127 |
| 6,718,709 | B2 | * | 4/2004 | Koutras et al. | 52/285.1 |
| 6,746,297 | B2 | * | 6/2004 | Robjent et al. | 446/108 |
| 7,118,442 | B2 | * | 10/2006 | Laliberte et al. | 446/85 |
| 7,438,623 | B2 | * | 10/2008 | Lin | 446/108 |
| D591,007 | S | * | 4/2009 | O'Neill | D30/121 |
| 7,908,718 | B2 | * | 3/2011 | Glasser | 24/336 |
| 8,051,535 | B2 | * | 11/2011 | Cheng | 16/82 |
| 2001/0010992 | A1 | * | 8/2001 | Brazier et al. | 446/108 |

* cited by examiner

BUILDING SET FOR TOY HOUSES

TECHNICAL FIELD

This invention relates to a building set for toy houses, in particular doll's houses and the like, comprising wall panels with and without openings for windows or doors, as well as coupling elements for assembling the wall panels, said wall panels being configured with an area of reduced thickness in each of the four corners for insertion into the coupling elements.

BACKGROUND

The document GB 1 315 223 discloses a building set for toy houses, which comprises wall panels with and without openings for windows or doors, and in which the corner areas are configured with a reduced thickness and with a boss arrangement, so that the wall panels may be assembled by means of a coupling element, which is not described in detail. However, the coupling element is shown as a rod-shaped element in FIG. 17.

One of the drawbacks of the building set is that the panels are configured as hollow moulded elements with edges and ribs, and that the corner area is provided with a boss arrangement, whereby the tooling and production costs will be disadvantageously large.

Another drawback of the building set is that the assembly of the panels with the coupling element must be presumed to be a problem to many small children who do not have fully developed motor skills as yet.

The document DE 2203152 discloses a building set for toy houses, which comprises wall and roof panels and a coupling element. The panels are configured with areas of reduced thickness along the edges, to receive the coupling element. The areas are equipped with depressions on both sides. None of the areas of reduced thickness are placed in the corners of the panel. The coupling element is configured as a wheel equipped with grooves which extend radially outwards from the center of the coupling. The grooves are equipped with bosses.

The shape of the coupling and the positions of the areas of reduced thickness means, that building and removal of the panels has to be conducted in a particular order making assembly difficult for children.

The shape of the coupling element is unfavourable with regard to placing the toy house safely on a floor or table and to the appearance of the house.

The document DE 20 2007 005 299 U1 discloses a building set for a toy castle, which comprises wall panels and coupling elements. The wall panels are configured with permanent secured straps of leather along the vertical edges and positioned to cooperate with the straps on the neighbouring panel and with a metal stick. The straps are secured in a recessed area on the edge of the wall panel, but none of the recessed areas are positioned on the corner of the panel. The coupling element functions as a hinge element, and the wall panels may be turned in different directions. The coupling is loose.

U.S. Pat. No. 5,871,384 discloses a block assembly and devices formed thereby. The block assembly comprises plane blocks and joint blocks. The plane blocks are either solid blocks or blocks configured of an upper plate and a lower plate. The solid blocks are configured with a recessed area in the middle of each of the edges to receive a coupling element. The two-plate blocks are configured with a groove in the middle of the edges to receive a coupling element. Neither the recessed area nor the groove is positioned in the corner of the block. The coupling elements are configured such that when connected to a block, the size of the block is increased.

THE OBJECTS OF THE INVENTION

It is an object of the invention to provide a building set of the type mentioned in the opening paragraph which remedies the drawbacks mentioned above.

The object stated above is achieved by arranging the building set such that the area of reduced thickness of the corners extends on both sides of the wall panel as a plane, recessed section of the wall panel, said section extending between staggered edges of the corner, the recessed section being provided with a depression centrally on both sides of the recessed section, the coupling element being provided with parallel lateral faces for enclosing the recessed section, both lateral faces being provided internally with a boss which is configured to engage the depression in the recessed section.

When the wall panel of a plate is configured with a recessed, plane corner section with a depression disposed centrally in the corner section, a very simple and inexpensive structure is achieved, which is suitable for production by known methods.

Moreover, in a simple manner, it is possible to insert the recessed section of a wall panel into the coupling element until the boss engages the depression in the recessed section and locks the position between the coupling element and the wall panel. It is ensured hereby that even small children will be able to use the building set.

With uniform recessed sections in each of the four corners, a wall panel may be arranged on any edge, thereby allowing free building. With rectangular panels, it is possible to build houses of different heights.

When the recess of the plane face and the stagger of the edges in the corner are configured with a dimensional jump corresponding to the thickness of the lateral faces of the coupling element, it is ensured that the assembly between the coupling element and the panel has a smooth transition.

When the recessed face section in the corner is configured as either a sector of a circle, a triangle or a quadrangle, it is ensured that the most optimal solution in terms of production and/or the most preferred appearance may be selected freely.

When the lateral faces of the coupling element are configured as plates which are interconnected with a back plate intended to cover the edges of the recessed section of the wall panel, a resilient element is achieved, which is capable of gripping the corner, and which also presents an attractive appearance.

When the lateral plates of the coupling element are configured so as to fit the selected configuration of the recessed section of the corner, it is ensured that the building set may be assembled, and that the building set may be manufactured in different variants.

When the coupling element is configured as a termination element comprising a set of lateral plates and two back plates, it is ensured that a free corner may be covered so as to present a finished appearance.

When the coupling element is configured as a corner element which is formed by two termination elements arranged at an angle with each other, it is ensured that a house corner may be assembled.

When the coupling element is configured as a straight element which is formed by two termination elements arranged in extension of each other and back to back, it is ensured that a facade consisting of several wall panels may be built.

When the coupling element is configured as an angular element which is formed by a straight element and a termination element arranged so that the elements form a T, it is ensured that room divisions may be established in the house.

It is moreover expedient to make the coupling elements of plastics and to make the wall panels of wood, cardboard or plastics.

BRIEF DESCRIPTION OF THE DRAWINGS

Exemplary embodiments of the invention will be explained more fully below with reference to the drawings, in which.

DETAILED DESCRIPTION OF THE INVENTION

Figure 1:
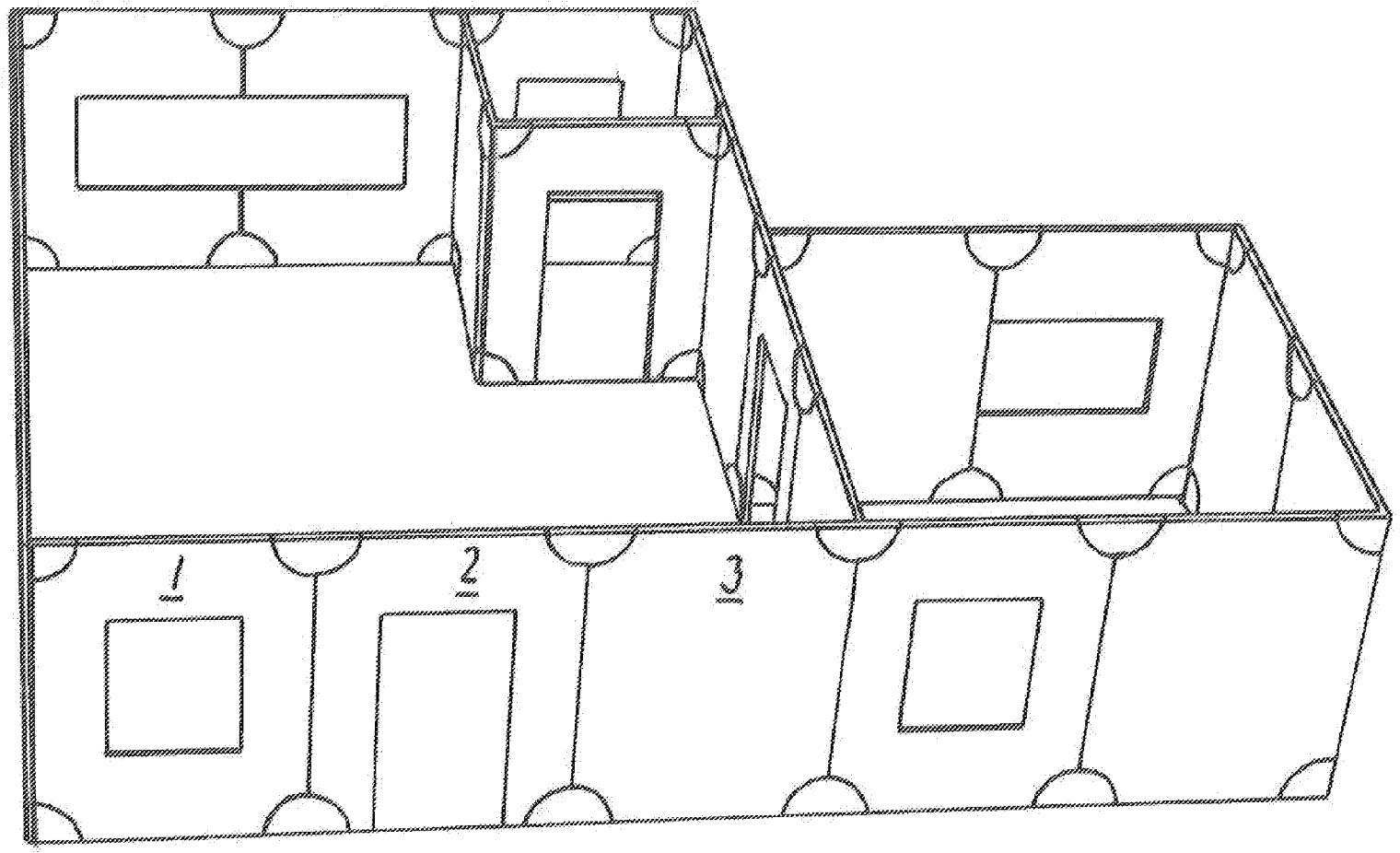
FIG. 1 shows an example of a doll's house made from the building set according to the invention.
Figure 2A:
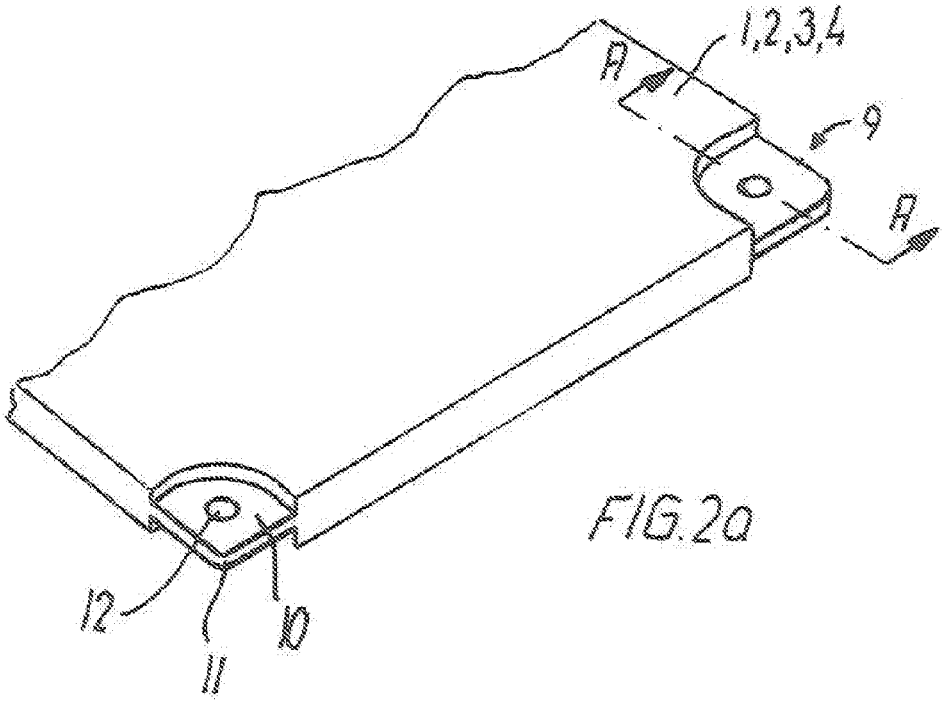
FIG. 2*a* is a perspective view of a section of a wall panel, seen in perspective.
Figure 2C:
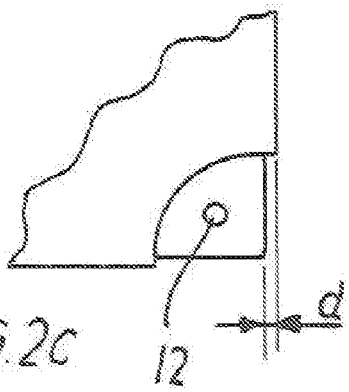
FIG. 2*c* shows a detailed view of a recessed section of a corner.
Figure 2B:
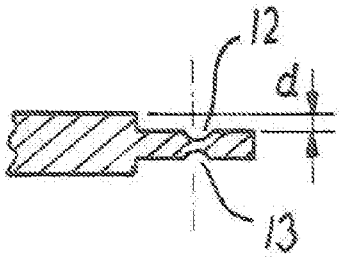
FIG. 2*b* shows a sectional view of a recessed section of a corner, taken along line A-A of FIG. 2*a*.

FIG. 1 shows a doll's house made from the building set according to the invention. It will be seen that the building set comprises wall panels of different types. The wall panel 1 is provided with a square window, the wall panel 2 is provided with a door opening, the wall panel 3 is a wall element without openings of any kind, and the wall panel 4 is configured with a window opening of rectangular shape and is e.g. suitable for being combined with another element of the same type to form a picture window.

The panels 1, 2, 3, 4 are coupled together to form a house by means of coupling elements 5, 6, 7, 8 which are disposed in each of the corner areas 9 of the panels.

It will be seen in FIGS. 1, 2*a*, 2*b* and 2*c* that each panel is additionally configured with recessed sections 10 in each of the four corners 9. The corners are configured with a view to being able to receive one of the coupling elements. The recessed section 10 extends on both sides of the wall panel as a plane, recessed section of the wall panel. The section extends between the edges 11 of the corner, and the recessed face is provided with a depression 12, 13 centrally on both sides.

The recessed section 10 may be configured either as a sector of a circle, a triangular section or a quadrangular section.

The recess in the corner is configured so that the size of the dimensional jump d corresponds to the thickness of the lateral faces of the coupling elements. The edges 11 of the corner are staggered relative to the edges of the wall panel. The size of this stagger also corresponds to the thickness of the lateral faces of the coupling elements. It is ensured thereby that there is a smooth transition between the wall panel and the coupling element, and that the external dimensions of the coupling elements are identical with the thickness of the wall panel.

Figure 3:
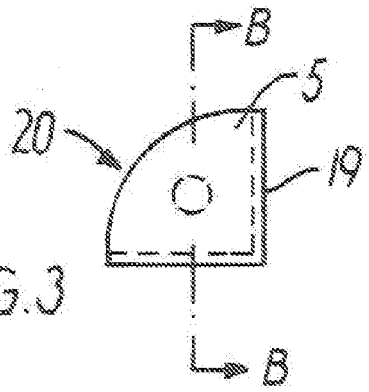
FIGS. 3 and 4 show a lateral view and a sectional view, respectively, of a coupling element, the sectional view taken along line B-B of FIG. 3.
Figure 4:
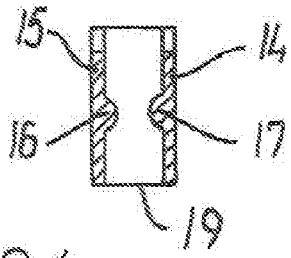

FIGS. 3 and 4 show a coupling element 5 configured as a termination element 20. The termination element is intended to be positioned on a free corner of a wall panel which is not to be connected with another wall panel.

The coupling element 5 is provided with two lateral plates 14, 15 and with two back plates 19. The back plates are arranged perpendicularly to each other and connect the two lateral plates. Each internal side of the lateral plates is provided with a boss 16, 17, which is intended to engage the depressions 12, 13 on the recessed section of the corner. The coupling element is flexible.

The lateral plates of the coupling elements are configured so as to correspond to the configuration of the recessed section of the corner.

Figure 5:
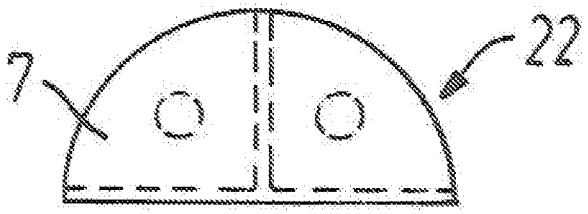
FIG. 5 shows a coupling element configured as a straight element.

FIG. 5 shows a coupling element 7 configured as a straight coupling element 22, which is intended for assembling wall panels placed in a row side by side so as to form a facade.

The coupling element 7 is formed by two adjoining termination elements 20 which are arranged back to back in extension of each other.

Figure 6:
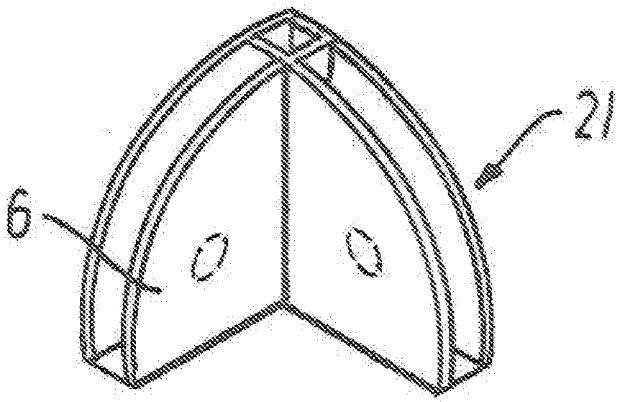
FIG. 6 shows a coupling element configured as a corner element.

FIG. 6 shows a coupling element 6 configured as a corner element 21 which is intended for assembling wall panels whose edges are arranged at an angle to each other so as to form a corner of a house.

The coupling element 6 is formed by two adjoining termination elements 20 arranged perpendicularly to each other.

Figure 7:
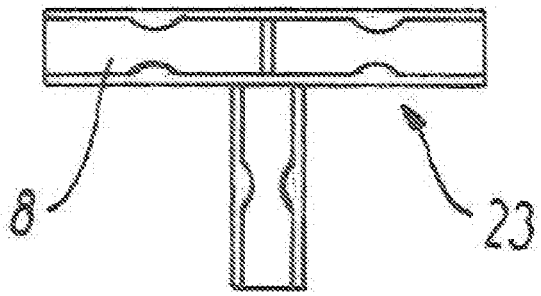
FIG. 7 shows a coupling element configured as an angular element.

FIG. 7 shows a coupling element 8 configured as an angular element 23 which is intended for assembling wall panels, which are arranged perpendicularly to each other with the purpose of establishing a room division in the house.

The coupling element 8 is formed by a straight element 22 and a termination element 20 which adjoin each other, said termination element being arranged perpendicularly to and centrally of the straight element so that, together, they form a T.

The coupling elements are made of plastics and are therefore flexible, so that it is easy to assemble the wall panels merely by inserting the panel into the coupling element until the boss engages the depression on the panel.

The wall panels may freely be made of wood, cardboard or plastics and with an attractive colour. Moreover, it is possible according to the invention to supplement the range of panels with cut-outs for windows of e.g. a triangular or hexagonal shape or other shapes. For instance, it is also possible to provide a panel with a cut-out for a garage door.

The invention claimed is:

1. A building set for building toy houses or doll's houses comprising:

a plurality of wall panels, each wall panel having a first planar side and a second planar side and having edges which form at least one wall panel corner;

at least one corner coupling element for coupling to the at least one wall panel corner;

each wall panel corner formed as a planar recessed corner section, having an area of reduced thickness, relative to a thickness of the wall panel, on each of the first planar side and the second planar side thereof;

each corner coupling element having a pair of opposed walls having lateral faces defining a channel space therebetween, the channel space sized for receiving the planar recessed corner section therein, each opposed wall being received in a corresponding area of reduced thickness of the planar recessed corner section;

each planar recessed corner section having a depression provided on the first and second planar sides thereof, the coupling element lateral faces each having a boss configured to engage a respective depression for removably fixing the corner coupling element to the planar recessed corner section.

2. The building set according to claim 1 wherein the corner coupling element has a second channel space defined by a second pair of lateral faces for receiving a planar recessed corner section of a second wall panel therein, thereby coupling at least two wall panels together.

3. The building set according to claim 1, wherein the planar recessed corner section has an edge indented relative to edges of the wall panel, each corner coupling element having a back plate having a thickness corresponding to a depth of the indent in the indented edge such that the coupling element opposed walls is flush with the planar sides and the back plate is flush with the edges of the wall panel when the corner coupling element is coupled thereto.

4. The building set according to claim 1, wherein the planar recessed corner section has a shape selected from the group consisting of a section of a circle, a triangular section or a quadrangular section.

5. The building set according to claim 1, wherein the corner coupling element opposed walls are parallel plates, a back wall connecting the parallel plates together.

6. The building set according to claim 4, wherein the opposed walls of the corner coupling element are shaped to match the shape of the planar recess corner section.

7. The building set according to claim 1, further comprising a corner termination element which comprises parallel lateral plates connected with two back plates which are arranged perpendicularly to each other, for enclosing the planar recessed corner section.

8. The building set according to claim 2, wherein the second channel space is arranged perpendicularly relative to the channel space for locating the second wall panel perpendicular relative to the wall panel.

9. The building set according claim 2, wherein the second channel space is in linear alignment with the channel space for locating the second wall panel in linear alignment with the wall panel.

10. The building set according to claim 9, wherein the corner coupling element further comprises a third pair of lateral walls for forming a third channel space perpendicular to the linearly aligned channel spaces, for locating a third wall panel perpendicularly relative to the linearly aligned wall panels, the corner coupling element forming a T shaped junction configured to enclose three planar recessed corner sections therein.

11. The building set according to claim 1, wherein the corner coupling element is made of plastic.

12. The building set according to claim 1, wherein the plurality of wall panels are made of a material selected from the group consisting of wood, cardboard or plastic.

13. The building set according to claim 1 wherein the plurality of wall panels include wall panels with or without window or door openings.

* * * * *